United States Patent [19]

Hovey

[11] 4,280,882

[45] Jul. 28, 1981

[54] METHOD FOR ELECTROPLATING SELECTED AREAS OF ARTICLE AND ARTICLES PLATED THEREBY

[75] Inventor: Ralph J. Hovey, Hot Springs, Ark.

[73] Assignee: Bunker Ramo Corporation, Oak Brook, Ill.

[21] Appl. No.: 97,289

[22] Filed: Nov. 14, 1979

[51] Int. Cl.[3] ..... C25D 5/02

[52] U.S. Cl. ..... 204/15; 204/DIG. 7

[58] Field of Search ..... 204/15, DIG. 7

[56] References Cited

U.S. PATENT DOCUMENTS

| | | | |
|---|---|---|---|
| 3,862,891 | 1/1975 | Smith | 204/DIG. 7 |
| 3,878,062 | 4/1975 | Grimaldi | 204/15 |
| 4,032,414 | 6/1977 | Helder | 204/15 |
| 4,035,245 | 7/1977 | Danneels | 204/15 |

FOREIGN PATENT DOCUMENTS

| | | | |
|---|---|---|---|
| 52-71345 | of 1977 | Japan | 204/15 |

*Primary Examiner*—T. M. Tufariello

*Attorney, Agent, or Firm*—F. M. Arbuckle; B. W. Sufrin

[57] ABSTRACT

A method and apparatus are disclosed for electroplating a selected portion of an article by carefully confining electrolyte contact to the selected portion of the article and establishing a generally uniform electrical field adjacent that selected portion. Electrolyte wetting of the article, which is partially immersed in an electrolytic plating bath maintained under agitation, is minimized by surrounding the article with a dielectric baffle to establish a quiescent zone on the bath surface adjacent the article. Thus, the selected portion of the article is fully exposed to the bath while electrolyte wetting of portions of the article outside of the selected portion is minimized by the baffle. A generally uniform plating of the selected portion is obtained by positioning an electrode in close proximity to the selected portion and maintaining a generally uniform separation between the selected portion and the electrode while an electrical potential is applied between the electrode and the article. In addition, the baffle contributes to the uniformity of plating by lengthening or screening current lines of force between the electrode and projecting areas of the selected portion. Undesirable plating of areas of the article outside of the selected portion may be further limited by establishing negative capillarity between the electrolyte and the baffle. Negative capillarity inhibits electrolyte wetting of these outside areas due to surface tension effects. The preferred plating metals are precious metals chosen from the group consisting of gold, rhodium, palladium, irridium, platinum and silver, and alloys thereof. The electroplating method and apparatus are particularly useful for selectively plating an elongated bore in a conductive article such as an electrical contact.

19 Claims, 9 Drawing Figures

METHOD FOR ELECTROPLATING SELECTED AREAS OF ARTICLE AND ARTICLES PLATED THEREBY

BACKGROUND OF THE INVENTION

The invention is directed generally to electroplating of selected portions of articles. More particularly, the invention is directed to a selective electroplating apparatus and method, and an article plated thereby. The invention involves control of electrolyte wetting of the article and production of a generally uniform electrical field adjacent the selected portions. In an important embodiment, selected portions of an inner surface of an elongated bore in a conductive article are electroplated.

The desirability of selectively and uniformly electroplating portions of articles arises from a number of considerations, including article design requirements. Where scarce precious metals, such as gold, are being electroplated, compelling economic and ecological reasons for avoiding unnecessary plating come into view. The present invention is therefor concerned with meeting design requirements for selective electroplating as well as avoiding waste of plating metal due to plating of unnecessary surfaces and non-uniform plating in excessive thicknesses.

Although the invention is useful in plating metals other than gold onto articles other than screw machine contacts, the present discussion will be generally confined to selective gold plating of electrical contacts, particularly screw machine contacts having elongated bores requiring gold electroplating. Thus, when the term "gold" is used hereinafter, it should be understood that, for example, any of the precious metals including gold, rhodium, palladium, irridium, platinum and silver and alloys thereof may be used. Similarly, electrical contacts other than screw machine contacts and electrical devices other than electrical contacts may be electroplated according to the present invention, as may articles useful in diverse unrelated fields such as the jewelry field.

Important advantages of the present invention over prior non-selective electroplating systems can be appreciated by an examination of conventional plating of screw machine type contacts. These contacts, which are manufactured on a screw machine from tubular stock, are generally tubular in overall shape and have elongated bores for engagement with corresponding contacts. Actual electrical continuity upon engagement is established at the entranceway of the bore of the screw machine contact.

It is desirable to plate gold on the entranceway of the screw machine contact bore because of its excellent conductive and wear properties and its resistance to corrosion. Placement of gold at the bore entranceway, the primary point of actual electrical contact, will improve electrical continuity and overall contact reliability.

The method conventionally employed to plate gold on screw machine contacts has been barrel plating. Barrel plating has been relied upon because it partially overcomes the difficulty of plating the irregular surfaces presented at the entrance to the contact bore by coating the entire contact with plating metal.

Barrel plating is well-suited to indiscriminately plating inexpensive metals onto screws and bolts where uniformity of coating thickness is not important. It is, however, ill-suited to plating expensive metals onto irregular surfaces where selectivity and uniformity of coating thickness are highly desired. It is also ill-suited to plating the inner surface of bores in articles subjected to plating.

Barrel plating of gold onto screw machine contacts thus results in considerable gold waste due to indiscriminate plating. It also produces a build-up of plating metal on projecting corners outside of the contact bore entranceway which wastes metal due to excessive deposition in areas remote from the primary electrical contact surfaces. This build-up at projecting corner, which is seen in other electroplating systems, arises due to the increased density of current flow which occurs at projecting edges of the article being plated.

While prior non-selective electroplating systems like barrel plating are undesirable for plating screw machine contacts for many reasons, including plating metal wastage, prior selective electroplating systems designed to reduce wastage also suffer a number of drawbacks. For one, prior selective systems offer no remedy to the build-up of plating metal at projecting corners adjacent the primary plating areas.

One commonly used selective plating technique is a partial immersion system commonly referred to as "dip plating" in which only a selected portion of the article to be plated is actually immersed in the plating solution. This technique is cumbersome and imprecise due to the difficulty of maintaining immersion depth in a rapidly agitating electrolytic bath. This method also suffers from poor selectivity due to plating resulting from splashing of electrolyte onto non-selected article areas.

Another selective plating technique entails the application of a non-conductive plating mask in the form of a paint, tape or other resistive coating to non-plating areas of each article being electroplated. The time consumed and difficulty of obtaining a tight seal between the mask and the article are considerable drawbacks of this technique, especially in the context of electroplating small, non-planar objects like screw machine contacts.

Yet another category of selective plating technique entails directing a stream of electrolyte against the area to be plated in the presence of the requisite charge density to produce plating. This technique, as in the case of partial immersion, suffers the drawback of electrolyte wetting of areas outside of the selected portion and the undesired plating resulting therefrom.

SUMMARY OF THE INVENTION

The present invention is directed to a method of electroplating a selected portion of an article partially immersed in an electrolytic plating bath maintained under agitation. Electrolyte wetting of portions of the article outside of the selected portion is minimized by controlling the flow of the electrolyte in the vicinity of the article. Agitation of the bath helps maintain a steady availability of plating ions at the site of plating notwithstanding the control of electrolyte flow. A generally uniform electrical field is established adjacent the selected portion by maintaining proper separation between the selected portion and the electrode, and by lengthening or screening current lines of force between the electrode and projecting areas of the selected portion.

Electrolyte wetting of areas of the article outside of the selected portion is minimized by surrounding the article with a baffle. The baffle is preferably either coated with or made of a material exhibiting negative capillarity with respect to the electrolyte. The baffle minimizes splashing onto the non-selected portions of the article and also reduces wetting of non-selected areas which would otherwise occur due to capillary action in the narrow passage between the article and the baffle.

The invention is particularly useful in electroplating elongated bores in conductive articles such as screw machine contacts in which the designated selected portion is the entranceway of the bore. The invention is also directed to articles, including particularly electrical contacts, plated in accordance with the above teaching.

It is an object of the present invention to provide a method and an apparatus for electroplating a selected portion of an article by carefully controlling electrolyte contact with the article.

It is another object of the present invention to provide a method and an apparatus for electroplating a selected portion of an article by controlling current distribution adjacent the selected portion.

Yet another object of the present invention is to provide a method and an apparatus for obtaining generally uniform electroplating of selected portions of articles, including particularly the entranceway of elongated bores in articles.

A further object of the present invention is to provide conductive articles having cavities selectively plated in accordance with the disclosed method, including particularly electrical contacts in which the cavities are elongated cylindrical bores adapted for receiving mating contacts.

In one important embodiment of the present invention, a selected portion of an article is electroplated by partially immersing the article in an electrolytic plating bath maintained under agitation, while a quiescent zone is maintained on the bath surface adjacent the article leaving the selected portion fully exposed to the bath while minimizing electrolyte contact with portions of the article outside of the selected portion. An electrode is positioned in close proximity to the selected portion and maintained at a generally uniform separation therefrom. Finally, an electrical potential is applied between the electrode and the article in order to establish a generally uniform electrical field adjacent the selected portion of the article to develop the desired plating thickness.

Other objects and features of the invention will become apparent upon examination of the following specification and drawings together with the claims. While the invention is described below in connection with preferred or illustrative embodiments, these embodiments are not intended to be exhaustive or limiting of the invention. Rather, the invention is intended to cover any alternatives, modifications, and equivalents that may be included within its spirit and scope as defined by the appended claims.

BRIEF DESCRIPTION OF THE DRAWINGS

Similar reference numerals are applied to corresponding features throughout the different figures of the drawings.

DETAILED DESCRIPTION OF THE INVENTION

Figure 1:
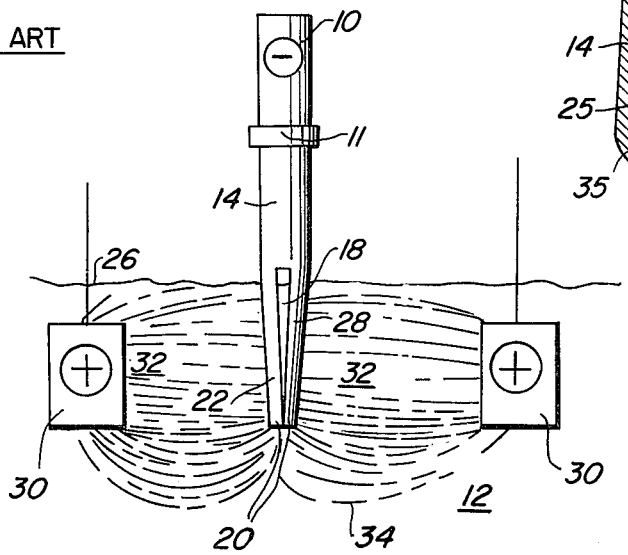
FIG-1 PRIOR ART
FIG. 1 is an enlarged elevation view of a cathodically charged screw machine contact partially immersed in a portion of an electrolytic plating bath with anodically charged electrodes positioned on either side of the immersed portion of the contact.
Figure 1A:
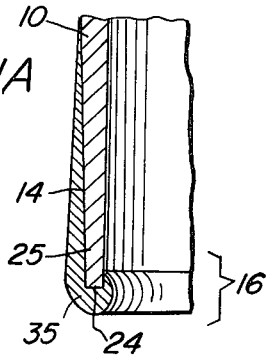
FIGS. 1A, 2A and 3A are fragmentary, exploded cross-sectional views of the bottommost immersed portions of the contacts depicted in corresponding FIGS. 1, 2 and 3 wherein the distribution of plating material is shown in a somewhat exaggerated form.
Figure 2:
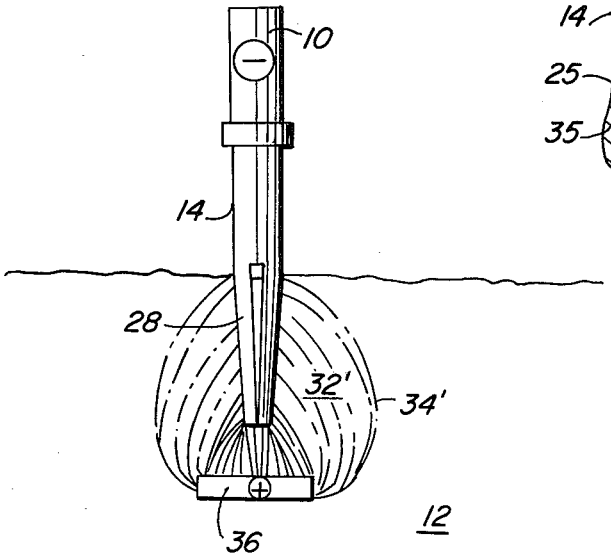
FIG. 2 is an enlarged elevation view of the plating bath depicted in FIG. 1 in which the dual anodically charged electrodes have been replaced by a single anode positioned in close proximity to the entranceway of the bore of the contact.
Figure 2A:
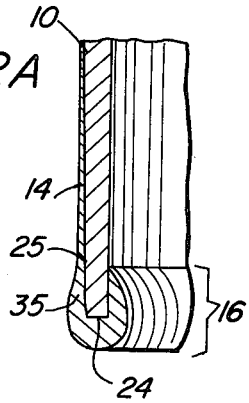

Turning now to the drawings, there is illustrated in FIGS. 1 and 1A a prior art immersion plating approach and in FIGS. 2 and 2A a somewhat improved immersion plating approach, which nevertheless fails to provide the various advantages inherent in the present invention. FIGS. 1 and 1A, in particular, depict a screw machine contact 10 with shoulder 11 vertically suspended in an electrolytic plating bath 12 composed of conventional electroplating bath components including metal plating ions. The contact 10 is cylindrical in shape and has an outer surface 14 and an inner axial bore with entranceway 16. Longitudinal slots 18 are cut into the wall of the contact in order to form spring legs 20. The legs 20 are pinched together at the entranceway 16 to the axial bore 20 to provide a radial bias upon engagement of the contacts 10 with corresponding contacts.

The electrolytic plating bath 12 has a bath surface 26 which defines the extent of the immersed portion 28 of the contact 10. Since the electrolytic plating bath 12 must be maintained under rapid agitation in order to sustain the necessary availability of plating metal ions adjacent the surface of the immersed portion 28, the actual level of the bath surface 26 and hence the extent of the immersed portion 28 will fluctuate. Also, rapid movement of the electrolytic plating bath 12 will cause splashing of the plating solution onto areas of the contact 10 beyond the immersed portion 28.

Electrodes 30 are positioned on either side of the immersed portion 28 of the contact 10. An electrical potential is established between these electrodes and the screw machine contact 10, which is of a conductive material such as beryllium-copper, and maintained for a period of time sufficient to develop the desired thickness of plating. The electrodes 30 are anodically charged, as indicated, with respect to the contact 10, which is cathodically charged. The circuit thus established between the electrodes 30 and the contact 10 results in a current density 32 with current lines of force 34. The current lines of force 34 are uneven in density with greatest concentration at the tip 24 of the contact 10 and at the immediately adjacent bottommost area 25 of the outer contact surface 14. The concentration of current lines of force 34 results in the plating of excess metal 35 at the tip 24 and adjacent bottommost surface 25 to the deprivation of plating in other areas of the contact 10. This phenomenon is well-known in electroplating and generally follows the proposition that there is an increased density of current lines of force or current flow and plating resulting therefrom at projecting sharp edges and exposed surfaces, while the opposite effect is manifested at depressions and corners of the article being plated.

Therefore, there is shown in FIG. 1A, in exaggerated form, a build-up of plating material 35 at the tip 24 and the adjacent bottommost surface 25 of the contact 10, as well as along the outer contact surface 14. This plating occurs to the deprivation of plating at the entranceway 16. Thus, the only point at which plating is actually desired, the entranceway 16 to the bore, receives relatively little plating metal.

FIGS. 2 and 2A correspond structurally to FIGS. 1 and 1A, but for the replacement of the electrodes 30 by a single electrode 36. The electrode 36 is positioned in close proximity to the entranceway 16 to the axial bore of the contact 10 to produce an improved orientation of the charge density 32' whereby the fewer current lines of force 34' flow to the outer surface 14 of the contact but more current lines of force flow to the tip 24 and the entranceway 16 of the contact 10. This results in the improved plating distribution depicted in FIG. 2A, which shows reduced plating at the outer surface 14 of the contact and increased plating on the bore entranceway 16, as well as a less desired build-up of plating at the contact tip 24.

The present invention represents an important advance over the plating techniques of FIGS. 1, 1A, 2 and 2A. In the preferred embodiment of the invention depicted in the remaining figures, a rigid dielectric baffle 38 partially surrounds the contact 10. The baffle 38 has elements 40 with faces 42 spaced apart and forming a predetermined path or aperture 44 in which the contacts 10 are suspended. Adjacent the aperture 44 at the top surfaces 46 of the baffle elements 40 are conductive strips 48 for establishing electrical contact during plating with the contacts 10 supported within the aperture 44.

Figure 3A:
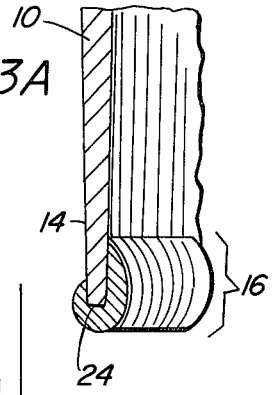
Figure 3:
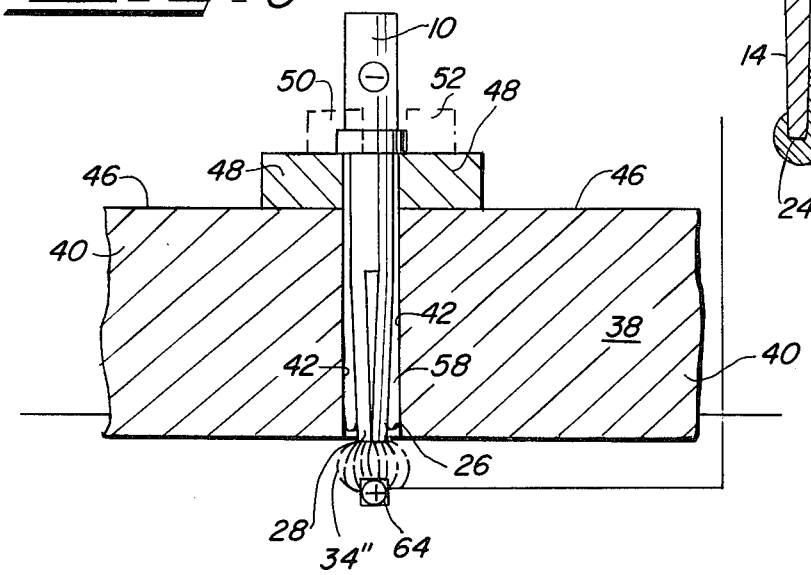
FIG. 3 is an elevation view of the plating bath of FIGS. 1 and 2 in which the screw machine contact is suspended in an aperture formed by spaced apart rigid dielectric baffle elements and a single anodically charged electrode of cross-section less than the cross-section of the aperture is positioned in close proximity to the entranceway of the bore of the contact.
Figure 4:
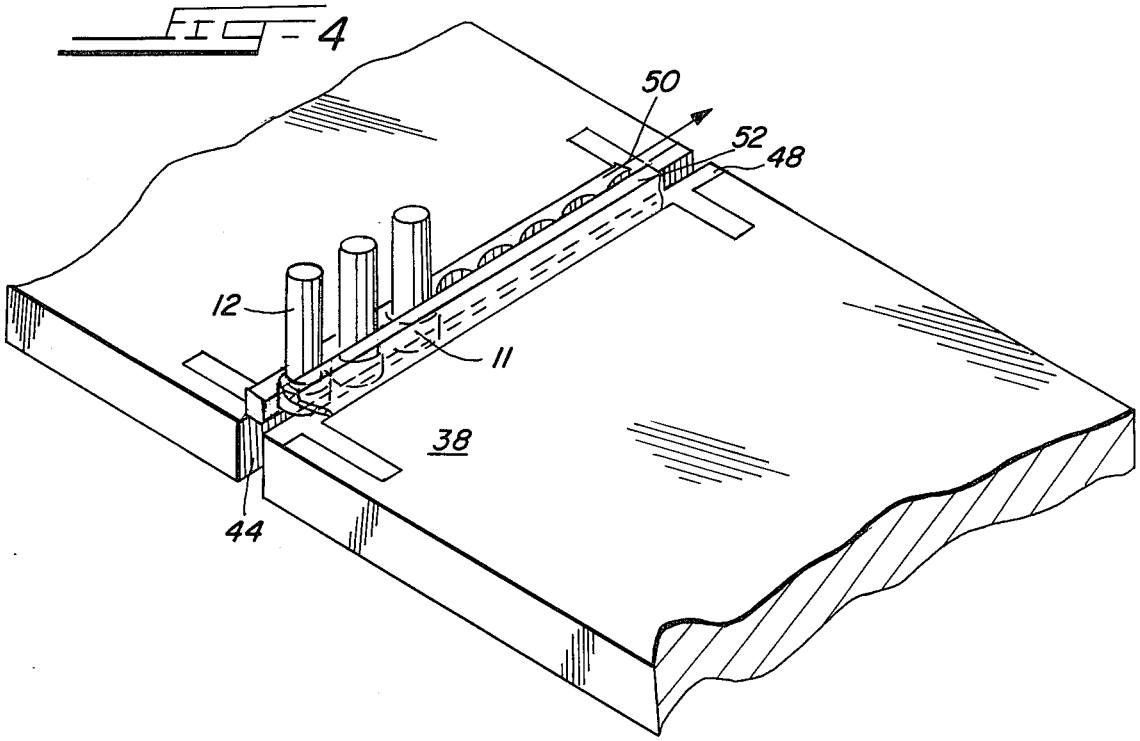
FIG. 4 is a perspective view of the electroplating bath and baffle elements of FIG. 3 in which a number of screw machine contacts are shown suspended within the aperture formed between the spaced apart baffle elements and wherein the structure includes a conductive surface and a cog belt and shoe arrangement adjacent the aperture.
Figure 5:
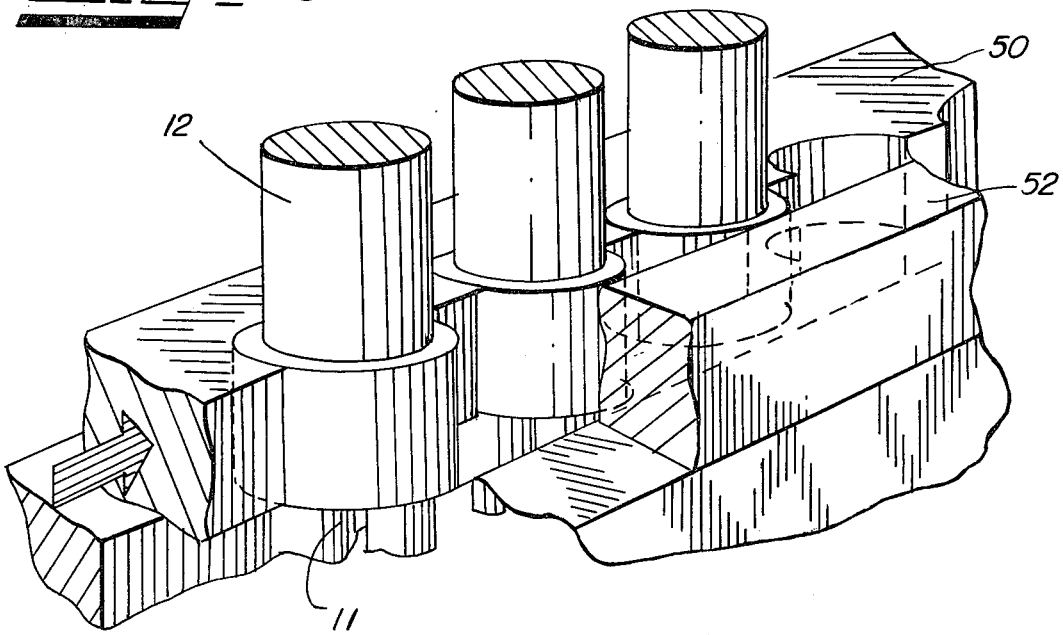
FIG. 5 is an exploded fragmentary view of the cog belt and shoe arrangement of FIG. 4 in which part of the shoe has been removed to improve clarity.
Figure 6:
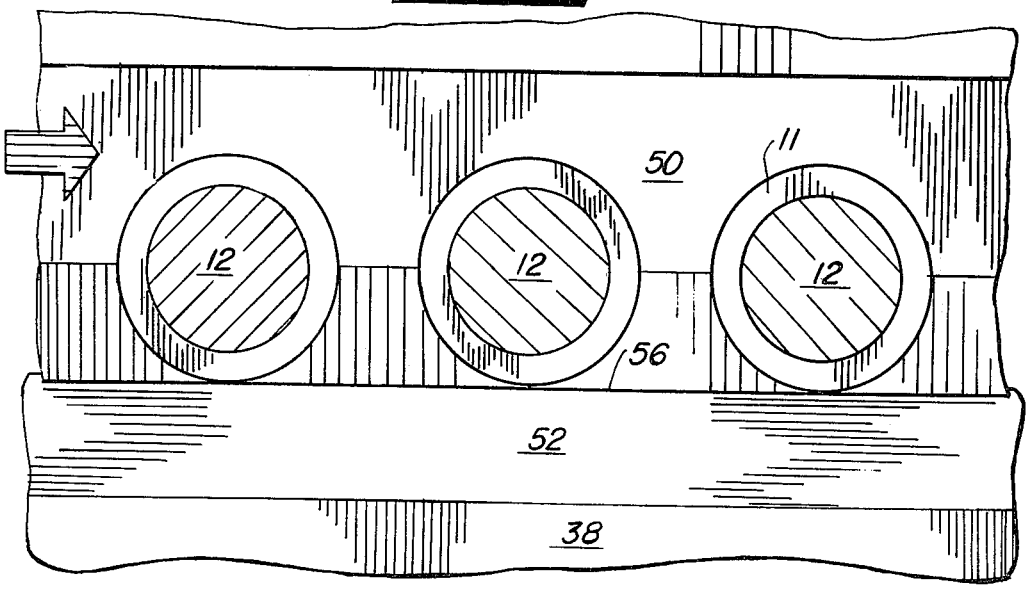
FIG. 6 is an enlarged plan view of the cog belt and shoe arrangement of FIG. 4 in which the contacts are shown rotating about their axes as they are moved along the aperture.

Included in the structure depicted in FIGS. 3 and 4 are conveying means in the form of cog belt 50 with back-up or stationary shoe 52 for serially moving contacts 10 along aperture 44. The shoe 52 may optionally be made of an electrically conductive material to help maintain electrical contact during plating with contacts 10. The combined action of the cog belt 50, pressing the annular contact shoulders 11 against the inwardly directed face 56 of the stationary shoe 52 while longitudinally moving the contacts along the aperture causes the contacts to rotate about their axes. In an alternate embodiment, the cog belt 50 may be replaced by a conventional flat-surfaced belt.

The rotation of the contacts improves metal plating ion availability at the desired plating site, the bore entranceway 16, by stirring the plating bath. Also, the rotating contacts experience improved uniformity of exposure to charge density resulting in improved uniformity of plating thickness. In the absence of rotation of individual contacts, a non-uniform charge density arises because immediately adjacent contacts will distort the current lines of force. The rotation of the contacts results in a relatively uniform circumferential presentation of each portion of the contact to the charge density, thereby improving uniformity of plating.

The rigid baffle 38, in addition to supporting the contacts 10, establishes a quiescent zone on the bath surface 26, notwithstanding the continuing agitation of the plating bath. Since it is desired to limit plating to the entranceway 16, the baffle and contact are adjusted within the bath 12 to confine the immersed portion 28 of the contact 10 to the vertical extent of the entranceway 16. Thus, entranceway 16 is fully exposed to the electrolytic plating bath 12 while electrolyte wetting of other portions of the contact 10 outside of the entranceway 16 due to movement of the bath surface 26 and due to splashing is minimized.

Additional control of electrolyte wetting of the outer surface 14 of the contact 10 is achieved according to the present invention by exploitation of the capillary effect. The capillary effect is a phenomenon which commonly occurs at the interface of a liquid intercepted by a solid surface and is directly related to the wettability of the solid surface by the particular liquid.

Thus, in the narrow cavity 58 between faces 42 of the baffle elements 40 and the outer surfaces 14 of the contacts 10, the capillary effect arising from the wettability of the baffle faces 42 and contact surfaces 14 would cause the electrolytic plating solution to rise along these surfaces thereby producing plating of undesired areas of contact surfaces 14.

However, according to the practice of the present invention, the movement of the electrolyte up the surfaces forming cavity 58 is greatly curtailed by establishing negative capillarity along the baffle faces 42. This negative capillarity is accomplished by coating the faces 42 of baffle elements 40 with a material exhibiting limited wettability with respect to the electrolyte bath, such as polytetrafluoroethylene, commonly referred to by the Dupont trademark "TEFLON".

An electrode 64 comprising an elongated conductor such as a bare wire of cross-sectional dimension smaller than the cross-section of the aperture 44 and made of a material inert in the plating bath is positioned below the aperture 42 and in close proximity to the portion selected to be plated, the entranceway 16. Since the elongated conductor runs parallel to the aperture, a generally uniform separation and hence generally uniformly distributed current lines of force 34" are maintained between the entranceways 14 of the contacts 10 and the electrode 16.

The electrode 64 should be positioned from 0.040 to 0.005 inches from the entranceway in order to optimize plating. Separation distances less than 0.005 inches should be avoided due to the likely interference between the electrode 64 and the movement of electrolytic plating solution adjacent the entranceway 16 which would result therefrom. Separation distances in excess of 0.050 inches should also be avoided due to the undesirable deflection of current lines of force to the entranceway which would result from this arrangement.

It is preferred that the ratio of available surface area of the electrode to the surface area intended to be plated be about 2:1. The term "available surface area" refers to the surface of the electrode 64 exposed to the article to be plated and supplying current density thereto.

As discussed above, the improved plating illustrated in FIGS. 3 and 3A is obtained by controlling electrolyte movement with the baffle 38 and by optimizing the distribution of current lines of force 34 with a carefully placed and carefully dimensioned electrode 64. A further contribution to uniformity of distribution of current lines of force 34'' (and hence plating) adjacent the entranceway 16 and in the surrounding area is achieved by the current shielding effect of the dielectric baffle 38, which lengthens or screens current lines of force between the electrode 64 and the outer surfaces 14 of the contacts 10, thereby reducing the concentration of current density and plating at those points. Relatively uniform plating occurs at the entranceway 16, as desired, and wasteful plating of metal at other surfaces is minimized. Furthermore, excessive plating in order to insure minimal coverage at entranceway 16 is no longer necessary.

The present electroplating method may be used with conventional plating metals in conventional plating baths. It is most useful, however, in the plating of precious metals such as gold, rhodium, palladium, irridium, platinum and silver and alloys thereof. Among these plating metals, gold is the most preferred.

I claim:

1. A method of electroplating a selected portion of the inner surface of an elongated bore in a conductive article comprising:

immersing at least the section of said article containing said selected portion in an electrolytic plating bath maintained under agitation;

controlling the flow of said bath to minimize electrolyte wetting of areas of said article outside of said selected portion; and positioning an electrode in close proximity to said bore with said electrode at a generally uniform distance from said selected portion, and establishing an electrical potential between said electrode and said article to produce a generally uniform electrical field against said selected portion.

2. A method for depositing a substantially uniform layer of metal onto conductive elongated cylindrical contact elements comprising:

vertically orienting and partially immersing said elements in an electrolytic plating bath and moving said elements along a predetermined path in said bath;

positioning an electrode in said bath and establishing an electrical field between said elements and said electrode; and maintaining said elements in a substantially uniform plating environment by agitating said bath to maintain a generally constant concentration of metal ions adjacent said elements and rotating said elements about their longitudinal axes as they move along said path to provide a balanced exposure of said elements to said electrical field.

3. The metal deposition method of claim 2 wherein said predetermined path is an elongated aperture in a rigid baffle.

4. The metal deposition method of claim 2 wherein a quiescent zone is established on the surface of the plating bath adjacent said elements.

5. The metal deposition method of claim 4 wherein said quiescent zone is established by surrounding said article with a baffle.

6. A method of electroplating selected portions of elongated bores in a plurality of discrete cylindrical electrical contacts comprising:

providing a reservoir of plating solution and baffle means covering the surface of said plating solution, said baffle means having an elongated aperture, allowing access to said plating solution;

supporting said contacts within said aperture with said selected portions suspended within said plating solution and partially surrounded by said baffle means;

serially moving said contacts along said aperture while rotating said contacts about their respective axes;

positioning an elongated electrode in said reservoir adjacent said aperture and in a manner sufficient to maintain a generally uniform separation between said selected portions of said contacts moving along said aperture and said electrode; and, applying an electrical potential between said electrode and said contacts.

7. A method of electroplating a selected portion of an article with minimal plating of adjacent areas of the article, comprising:

immersing a baffle in an electrolytic plating bath maintained in agitation to establish a quiescent zone of said bath between opposing faces of said baffle;

immersing said article in said bath with said selected portion suspended in said quiescent zone; and positioning an electrode from 0.040 to 0.005 inches from said selected portion, maintaining a generally uniform separation between said selected portion and said electrode and applying an electrical potential between said electrode and said article;

said opposing baffle faces confronting upon said adjacent areas to minimize splashing of electrolyte onto said adjacent areas and to shield current lines of force from said adjacent areas thereby minimizing plating of said adjacent areas while increasing plating of said selected portion.

8. The electroplating method of claim 7 wherein electrolyte wetting of said adjacent areas of said article is further minimized by establishing negative capillarity on the faces of said baffle with respect to said bath.

9. The electroplating method of claim 7 wherein the ratio of the available surface area of said electrode to the surface area of said selected portion is about 2:1.

10. The electroplating method of claim 7 wherein the plating metal is a precious metal chosen from the group consisting of gold, rhodium, palladium, irridium, platinum and silver.

11. The electroplating method of claim 7 wherein the plating metal is gold.

12. A method of electroplating a selected portion of the inner surface of an elongated bore in a conductive article with minimal plating of the outer surface of the article comprising:

immersing a baffle in an electrolytic plating bath maintained in agitation to establish a quiescent zone of said bath between opposing faces of said baffle;

immersing said article in said bath with said selected portion suspended in said quiescent zone; and positioning an electrode from 0.040 to 0.005 inches from said selected portion, maintaining a generally uniform separation between said selected portion and said electrode and applying an electrical potential between said electrode and said article;

said opposing baffle faces confronting upon said outer surface to minimize splashing of electrolyte onto said outer surface and to shield current lines of force from said outer surface thereby minimizing plating of said outer surface while increasing plating of said selected portion.

13. The electroplating method of claim 12 wherein electrolyte wetting of said outer surface of said article is further minimized by establishing negative capillarity on the faces of said baffle with respect to said bath.

14. A conductive article having cavities selectively plated in accordance with the process of claim 12.

15. A conductive article comprising an electrical contact having elongated cylindrical bores plated in accordance with the teaching of claim 12, said bores being adapted for receiving mating contacts.

16. A method for depositing a layer of metal onto selected portions of conductive articles with minimal plating of adjacent areas of the article comprising the steps of:

at least partially immersing a baffle in an electrolytic plating bath maintained in agitation to establish a quiescent zone between opposing faces of said baffle, said quiescent zone defining a predetermined path through said bath;

immersing said articles in said bath with said selected portion suspended in said quiescent zone and moving said articles along said predetermined path; and positioning an electrode from 0.040 to 0.005 inches from said selected portions, maintaining a generally uniform separation between said selected portion and said electrode and applying an electrical potential between said electrode and said articles;

said opposing baffle faces confronting upon said adjacent areas to minimize splashing of electrolyte onto said adjacent areas and to shield current lines of force from said adjacent areas thereby minimizing plating of said adjacent areas while increasing plating of said selected portions.

17. The metal deposition method of claim 16 wherein said baffle portions each include a conductive surface adjacent said path and said articles are carried along said predetermined path in electrical contact with the conductive surface of at least one of said baffle portions.

18. The method of claim 16 wherein said electrolytic deposition onto said adjacent areas is restricted by establishing negative capillarity on the faces of said baffle elements adjacent said path with respect to said bath.

19. The method of claim 16 wherein said conductive articles are serially moved along said predetermined path while being rotated about their respective axes.

* * * * *